US011078586B2

(12) United States Patent
Furukawa et al.

(10) Patent No.: US 11,078,586 B2
(45) Date of Patent: Aug. 3, 2021

(54) ZINC-NICKEL COMPOSITE PLATING BATH, ZINC-NICKEL COMPOSITE PLATING FILM, MOLD AND PLATING METHOD

(71) Applicant: HONDA MOTOR CO., LTD., Tokyo (JP)

(72) Inventors: Yuki Furukawa, Tochigi-ken (JP); Yoshimitsu Ogawa, Tochigi-ken (JP); Masahiro Yamanaka, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 59 days.

(21) Appl. No.: 16/333,267

(22) PCT Filed: Sep. 13, 2017

(86) PCT No.: PCT/JP2017/033035
§ 371 (c)(1),
(2) Date: Mar. 14, 2019

(87) PCT Pub. No.: WO2018/052023
PCT Pub. Date: Mar. 22, 2018

(65) Prior Publication Data

US 2019/0249323 A1 Aug. 15, 2019

(30) Foreign Application Priority Data

Sep. 16, 2016 (JP) ..... JP2016-181152

(51) Int. Cl.

| | |
|---|---|
| ***C25D 3/56*** | (2006.01) |
| ***C25D 5/36*** | (2006.01) |
| ***C25D 15/00*** | (2006.01) |
| ***C25D 7/00*** | (2006.01) |
| ***C25D 7/04*** | (2006.01) |
| ***B22D 17/22*** | (2006.01) |
| ***B22C 9/06*** | (2006.01) |

(52) U.S. Cl.
CPC ..... *C25D 3/565* (2013.01); *B22C 9/06* (2013.01); *B22D 17/22* (2013.01); *C25D 5/36* (2013.01); *C25D 7/00* (2013.01); *C25D 7/04* (2013.01); *C25D 15/00* (2013.01)

(58) Field of Classification Search
None
See application file for complete search history.

(56) References Cited

U.S. PATENT DOCUMENTS

| | | | | |
|---|---|---|---|---|
| 4,839,241 | A * | 6/1989 | Abe | C25D 15/02 428/659 |
| 4,985,311 | A | 1/1991 | Shindou et al. | |
| 2006/0096692 | A1* | 5/2006 | Sato | C04B 35/4682 156/89.11 |
| 2010/0208410 | A1* | 8/2010 | Okada | B22F 1/0011 361/301.4 |

FOREIGN PATENT DOCUMENTS

| | | | | |
|---|---|---|---|---|
| CN | 105463534 | A * | 12/2015 | |
| EP | 2757133 | B1 * | 12/2016 | |
| GB | 1531804 | * | 11/1978 | |
| JP | 58-055585 | A * | 4/1983 | C25D 3/56 |
| JP | 59-211589 | A * | 11/1984 | C25D 3/56 |
| JP | 62-006760 | | 2/1987 | |
| JP | 63-41994 | B2 * | 8/1988 | C25B 11/06 |
| JP | 63-277797 | | 11/1988 | |
| JP | 01-230797 | | 9/1989 | |
| JP | 07-258895 | | 10/1995 | |
| JP | 08-260199 | | 10/1996 | |
| JP | 09-052171 | | 2/1997 | |
| JP | 2008-240036 | | 10/2008 | |
| JP | 2015-150568 | | 8/2015 | |
| WO | WO 03/006725 | A1 * | 1/2003 | D01F 9/12 |

OTHER PUBLICATIONS

ASTM Standard B242-99 Standard Guide for Preparation of High-Carbon Steel for Electroplating, pub. by ASTM, Sep. 2015, pp. 1-5 (Year: 2015).*
Machine translation of JPS57207183 A (equivalent of JP 63-41994 B2) (Year: 1988).*
Machine translation of JP 59-2111589 A (Year: 1984).*
Machine translation of JP 58-055585 A (Year: 1983).*
International Search Report and Written Opinion for International Application No. PCT/JP2017/033035 dated Oct. 24, 2017, 11 pages.
"Codeposition Behavior of Zn—Ni—Si02 Composite Platings", Akira Takahashi et al., Journal of the Surface Finishing Society of Japan, 1993, vol. 44, No. 11, pp. 977-982.
"Effects of Nano-SiO2 on Corrosion Resistance of Electrodeposited Zn—Ni Alloy Coating", Xiang Tengfei et al., Plating and Finishing, vol. 37, No. 02 Serial No. 263, pp. 28-32.
Chinese Office Action for Chinese Patent Application No. 201780056940.4 dated Jul. 21, 2020.

* cited by examiner

*Primary Examiner* — Harry D Wilkins, III
(74) *Attorney, Agent, or Firm* — Amin, Turocy & Watson, LLP

(57) ABSTRACT

This zinc-nickel composite plating bath contains a zinc source, a nickel source, silicon dioxide particles and an ammonium-based dispersant in such ranges that enable the achievement of a zinc-nickel composite plating film wherein the codeposition amount of nickel is 10-16 wt % and the codeposition amount of the silicon dioxide particles is 7 vol % or more. Meanwhile, the pH of this zinc-nickel composite plating bath is 5.6 to 6.8.

7 Claims, 2 Drawing Sheets

ZINC-NICKEL COMPOSITE PLATING BATH, ZINC-NICKEL COMPOSITE PLATING FILM, MOLD AND PLATING METHOD

TECHNICAL FIELD

The present invention relates to a zinc-nickel composite plating coating (film) containing a co-deposited silicon dioxide particle, a zinc-nickel composite plating bath for forming the coating, a mold having the coating on an inner surface of a coolant passage, and a plating method for forming the coating.

BACKGROUND ART

In a mold for casting, injection molding, or the like, a coolant passage for a coolant water is formed to control the temperature of the mold. For example, by supplying the coolant water through the coolant passage, the mold can be maintained at an optimum temperature in a molding process, and the mold can be efficiently cooled after a molding process. In a case where the coolant passage is in contact with the coolant water for a longer time, a larger amount of a corrosion product or a sediment derived from calcium or bacterium in the coolant water is attached to the coolant passage. In this case, because the corrosion product has a low thermal conductivity, the mold temperature control cannot be stably performed. Furthermore, when the amount of the attached corrosion product or sediment is increased during use of the mold, the flow of the coolant water may be obstructed, and the mold temperature control cannot be stably performed.

In view of this problem, a washing method is proposed in Japanese Laid-Open Patent Publication No. 09-52171. In this washing method, the amount of the sediment attached to an inner surface of the coolant passage is measured. When the measured amount becomes equal to or more than a predetermined amount, the sediment is removed by a flow of a washing liquid through the coolant passage.

SUMMARY OF THE INVENTION

The washing method described in Japanese Laid-Open Patent Publication No. 09-52171 is used for washing out the sediment attached to the inner surface of the coolant passage. The washing method is not intended to remove the corrosion product generated by the corrosion of the inner surface of the coolant passage. Therefore, the corrosion product is not removed by the washing method. When the amount of the attached corrosion product is increased, the flow of the coolant water may be obstructed, and the mold temperature control cannot be stably performed in some cases. Furthermore, when a high-temperature molding step and a mold cooling step are repeatedly carried out, a surface of the mold may be subjected to a thermal stress due to the thermal amplitude, and stress corrosion cracking may be caused in a corroded portion on the surface disadvantageously.

A principal object of the present invention is to provide a zinc-nickel composite plating bath capable of preventing both of attachment of a sediment derived from calcium, bacterium, or the like and of a corrosion product generated due to corrosion.

Another object of the present invention is to provide a zinc-nickel composite plating coating capable of preventing both of attachment of a sediment derived from calcium, bacterium, or the like and of attachment of a corrosion product generated due to corrosion.

A further object of the present invention is to provide a mold having the zinc-nickel composite plating coating.

A still further object of the present invention is to provide a plating method for producing the zinc-nickel composite plating coating.

According to an aspect of the present invention, there is provided a zinc-nickel composite plating bath comprising a zinc source, a nickel source, a silicon dioxide particle, and an ammonium-based dispersant for forming a zinc-nickel composite plating coating having a co-deposited nickel content of 10 to 16 Wt % and a co-deposited silicon dioxide particle content of 7 Vol % or more, wherein the zinc-nickel composite plating bath has a pH of 5.6 to 6.8.

The zinc-nickel composite plating bath of the present invention (hereinafter referred to simply as the plating bath) is capable of forming a zinc-nickel composite plating coating (hereinafter referred to simply as the plating coating) having both of a hydrophilic property and an anticorrosion property. A sediment derived from calcium, bacterium, or the like can be easily washed out with water due to the hydrophilic property, and generation of a corrosion product can be prevented due to the anticorrosion property.

By using the ammonium-based dispersant at the pH controlled within the above range, 7 Vol % or more of the hydrophilic silicon dioxide particle can be effectively co-deposited, and the resultant plating coating can have the hydrophilic property suitable for easily washing out the sediment.

As described above, the plating bath contains the zinc source and the nickel source for forming the plating coating having a co-deposited nickel content of 10 to 16 Wt. For example, the resultant zinc-nickel alloy is such that the electric potential difference between a steel material and the zinc-nickel alloy is smaller than that between the steel material and another metal material having an ionization tendency higher than that of the steel material.

Therefore, for example, in the case of forming the plating coating on the steel material, even when a part of a surface of the steel material is exposed from the plating coating, the plating coating is oxidized to release electrons whereas the steel material is prevented from releasing electrons. Thus, the steel material can be prevented from being corroded due to the sacrificial anticorrosion effect. In addition, because the electric potential difference between the plating coating and the steel material is small as described above, generation of a corrosion current can be prevented. Consequently, the steel material having the plating coating can exhibit an effectively improved corrosion resistance.

When the co-deposited nickel content is controlled within the above range, the nickel can have a y single phase structure in the plating coating, whereby the corrosion resistance of the plating coating can be further improved.

The plating bath is capable of preventing the attachment to the steel material or the like of both the sediment derived from calcium, bacterium, or the like and the corrosion product generated due to corrosion in this manner.

In the zinc-nickel composite plating bath, it is preferred that the silicon dioxide particle has a scale-like shape or a dendritic shape. The scale-like or dendritic silicon dioxide particle has a specific surface area larger than that of a silicon dioxide particle having a grain shape or the like. The plating coating formed by using the scale-like or dendritic silicon dioxide particle has a larger surface area of the silicon dioxide particle effectively. In this case, the plating coating can have an improved hydrophilic property, so that the sediment attached to the plating coating can be washed out more easily.

According to another aspect of the present invention, there is provided a zinc-nickel composite plating coating having a co-deposited nickel content of 10 to 16 Wt % and a co-deposited silicon dioxide particle content of 7 Vol % or more. As described above, the plating coating of the present invention has both of the excellent hydrophilic property and the excellent anticorrosion property. Consequently, the plating coating is capable of preventing both of the attachment of the sediment and the attachment of the corrosion product.

Also in the zinc-nickel composite plating coating, it is preferred that the silicon dioxide particle has a scale-like shape or a dendritic shape. In this case, the plating coating can effectively have a larger surface area of the silicon dioxide particle to improve the hydrophilic property, so that the attached sediment can be washed out more easily.

According to a further aspect of the present invention, there is provided a mold having a coolant passage, wherein a zinc-nickel composite plating coating having a co-deposited nickel content of 10 to 16 Wt % and a co-deposited silicon dioxide particle content of 7 Vol % or more is formed on an inner surface of the coolant passage. In the mold of the present invention, the plating coating having the excellent hydrophilic property and the excellent anticorrosion property is formed on the inner surface of the coolant passage. Therefore, the mold can be maintained at an optimum temperature. Furthermore, even when the mold is in contact with the coolant water for a long time, the flow of the coolant water can be efficiently circulated through the mold.

Thus, even when the sediment derived from calcium, bacterium, or the like in the coolant water is attached to the plating coating formed on the inner surface of the coolant passage, water can easily penetrate between the sediment and the plating coating because of the excellent hydrophilic property. Consequently, the sediment can be easily removed from the coolant passage before the amount of the attached sediment is increased.

Because the plating coating is formed on the inner surface of the coolant passage, contact of water with the inner surface (the base material) can be prevented. Even when a part of the inner surface of the coolant passage (the base material) is exposed from the plating coating, a sufficient sacrificial anticorrosion effect can be achieved, and generation of a corrosion current can be prevented between the plating coating and the inner surface of the coolant passage (the base material). In addition, the nickel deposited in the plating coating has a y single phase structure, which is more excellent in corrosion resistance than the other phase structures. Consequently, the attachment of the corrosion product to the inner surface of the coolant passage can be prevented.

A melt having a temperature of 500° C. or higher may be injected into a cavity formed in the mold. When the deposited nickel content is controlled within the above range, the plating coating is excellent in heat resistance and is not decomposed even at such a high temperature. Furthermore, even when the silicon dioxide particle is deposited as described above, the plating coating can have a satisfactory thermal conductivity. Therefore, thermal exchange between the coolant water and the inner surface of the coolant passage is not inhibited by the plating coating. Consequently, the plating coating can be suitably used on the inner surface of the coolant passage in the mold.

Even when the mold is continuously used, the plating coating formed on the inner surface of the coolant passage can be maintained in a good state, so that the increase in the amount of the sediment attached and the attachment of the corrosion product can be effectively prevented. Therefore, the thermal exchange via the coolant passage between the coolant water and the mold can be prevented from being inhibited by the corrosion product having a low thermal conductivity. Furthermore, the coolant water can be efficiently circulated through the coolant passage. As a result, the control of the temperature of the mold can be stably performed, so that the mold can be maintained at an optimum temperature in a molding process, and the mold can be efficiently cooled after a molding process. Furthermore, the maintenance cycle of the mold can be prolonged.

In the above mold, it is preferred that the zinc-nickel composite plating coating has a thickness of 50 to 300 μm. In this case, even when the plating coating is exposed to a water pressure of the coolant water running through the coolant passage, the plating coating can be effectively prevented from being broken or peeled off from the inner surface of the coolant passage. Therefore, the durability of the plating coating can be improved.

Also in the mold, it is preferred that the silicon dioxide particle in the zinc-nickel composite plating coating has a scale-like shape or a dendritic shape. In this case, the plating coating can effectively have a larger surface area of the silicon dioxide particle to improve the hydrophilic property, so that the attached sediment can be washed out more easily.

According to a still further aspect of the present invention, there is provided a plating method for forming a zinc-nickel composite plating coating on a surface of a steel material to be plated. The plating method comprises: a degreasing step of removing an oil component from the surface; an etching treatment step of removing an oxide layer from the surface after the oil component removal; a desmutting step of removing a water-insoluble metal component from the surface after the oxide layer removal; and a plating step of subjecting the surface to an electroplating treatment using a zinc-nickel composite plating bath after the metal component removal to form the zinc-nickel composite plating coating. The zinc-nickel composite plating bath contains a zinc source, a nickel source, a silicon dioxide particle, and an ammonium-based dispersant, and has a pH of 5.6 to 6.8. The zinc-nickel composite plating coating has a co-deposited nickel content of 10 to 16 Wt % and a co-deposited silicon dioxide particle content of 7 Vol % or more.

In the plating method of the present invention, the plating coating having both of the excellent hydrophilic property and the excellent anticorrosion property can be effectively formed on the surface of the steel material. Consequently, the attachment of both of the corrosion product and the sediment derived from calcium, bacterium, or the like to the surface of the steel material can be prevented.

In a case where the degreasing step, the etching treatment step, and the desmutting step are carried out prior to the plating step as described above, the plating coating can be formed more effectively on the surface, so that the durability of the plating coating can be improved.

Also in the plating method, it is preferred that the silicon dioxide particle has a scale-like shape or a dendritic shape. In this case, the plating coating can effectively have a larger surface area of the silicon dioxide particle to improve the hydrophilic property, so that the attached sediment can be washed out more easily.

In the plating method, it is preferred that the steel material is a mold and the surface to be plated is an inner surface of a coolant passage formed in the mold. In this case, thermal exchange via the coolant passage between the coolant water and the mold can be prevented from being inhibited by the corrosion product having a low thermal conductivity. Furthermore, even when the mold is continuously used, a flow rate of the coolant water in the coolant passage can be maintained in a good state. Thus, the temperature of the mold can be stably controlled for a long time, so that the mold can be maintained at an optimum temperature in a molding process, and the mold can be efficiently cooled after a molding process. In addition, the maintenance cycle of the mold can be prolonged.

DESCRIPTION OF EMBODIMENTS

A preferred embodiment of the zinc-nickel composite plating bath, the zinc-nickel composite plating coating, the mold, and the plating method of the present invention will be described in detail below with reference to the accompanying drawings.

Figure 1:
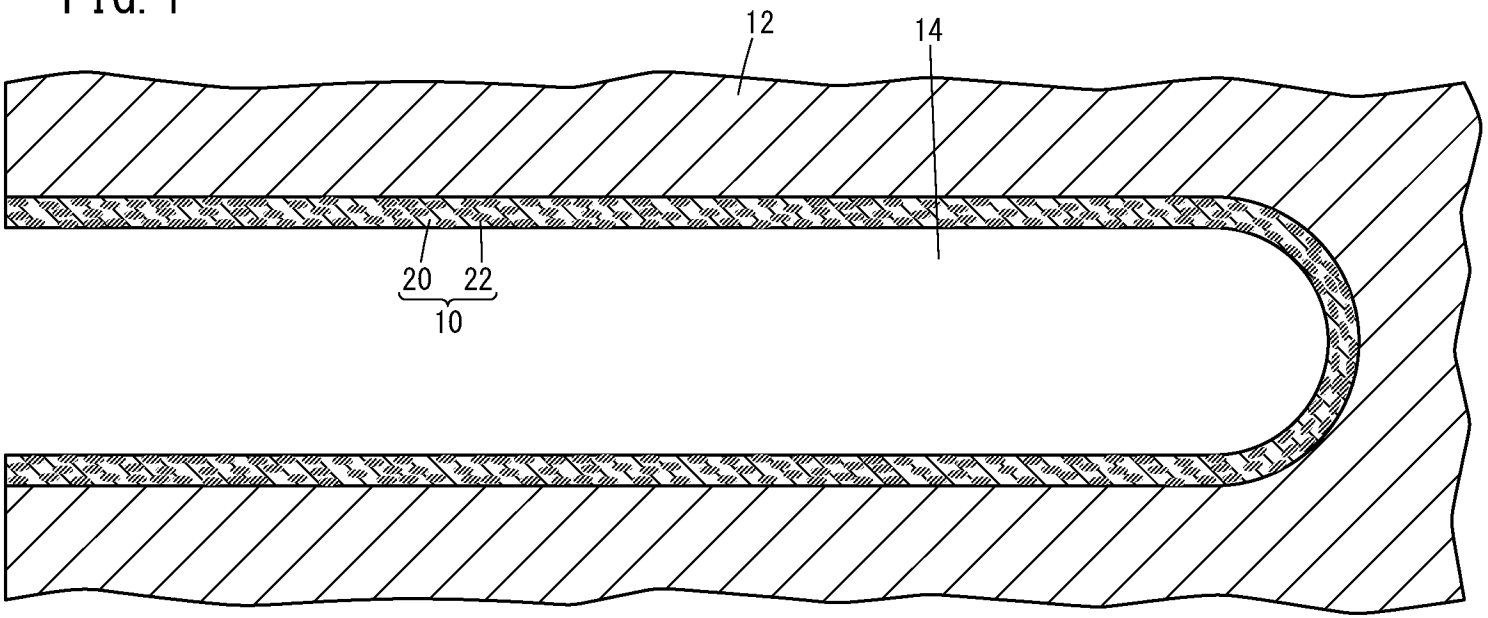
FIG. 1 is a schematic cross-sectional view of a zinc-nickel composite plating coating formed on an inner surface of a coolant passage in a mold according to an embodiment of the present invention.

As shown in FIG. 1, a mold 12 has a bottomed hole of a coolant passage 14, and a zinc-nickel composite plating coating 10 according to this embodiment (hereinafter referred to simply as the plating coating 10) is formed on an inner surface of the coolant passage 14.

Specifically, the mold 12 is intended to be used for casting, injection molding, or the like. For example, the coolant passage 14 is formed in a wall in the vicinity of a cavity (not shown), and a coolant water is circulated through the coolant passage 14. The mold 12 contains a steel material such as SKD61.

The plating coating 10 is a composite plating layer containing a matrix 20 and silicon dioxide particles 22. The matrix 20 contains a zinc-nickel alloy, and the silicon dioxide particles 22 are co-deposited with the zinc-nickel alloy. The content of the co-deposited silicon dioxide particles 22 is 7 Vol % or more. The plating coating 10 has a thickness of 50 to 300 μm. The inner surface of the coolant passage 14 in the mold 12 is covered approximately uniformly with the plating coating 10 to prevent the contact between the inner surface and the coolant water.

The content of the co-deposited nickel in the matrix 20 is 10 to 16 Wt %. Therefore, the nickel in the matrix 20 has a y single phase structure. The silicon dioxide particle 22 has a hydrophilic property, and has a scale-like shape or a dendritic shape with an increased specific surface area.

The plating coating 10 can be formed by a plating method using a zinc-nickel composite plating bath (solution) according to this embodiment (hereinafter referred to simply as the plating bath). The plating method will be described below with reference to FIG. 2.

The plating bath contains a zinc source, a nickel source, the silicon dioxide particles 22, and an ammonium-based dispersant in such a manner that the resultant plating coating 10 has a co-deposited nickel content of 10 to 16 Wt % and a co-deposited silicon dioxide particle content of 7 Vol % or more as described above.

For example, the zinc source is preferably zinc chloride, and the nickel source is preferably nickel chloride. In this case, for example, it is preferred that the plating bath contains 50 g/L of the zinc chloride, 30 g/L of the nickel chloride, 200 g/L of the ammonium-based dispersant, and 200 g/L of the silicon dioxide particles 22.

The pH of the plating bath is controlled to a value of 5.6 to 6.8 by the ammonium-based dispersant. It is more preferred that the plating bath has a pH of 6.2 to 6.6. In this case, the co-deposited silicon dioxide particle 22 content can be easily controlled within the above range while effectively preventing recrystallization or the like of the zinc source or the nickel source in the plating bath.

Figure 2:
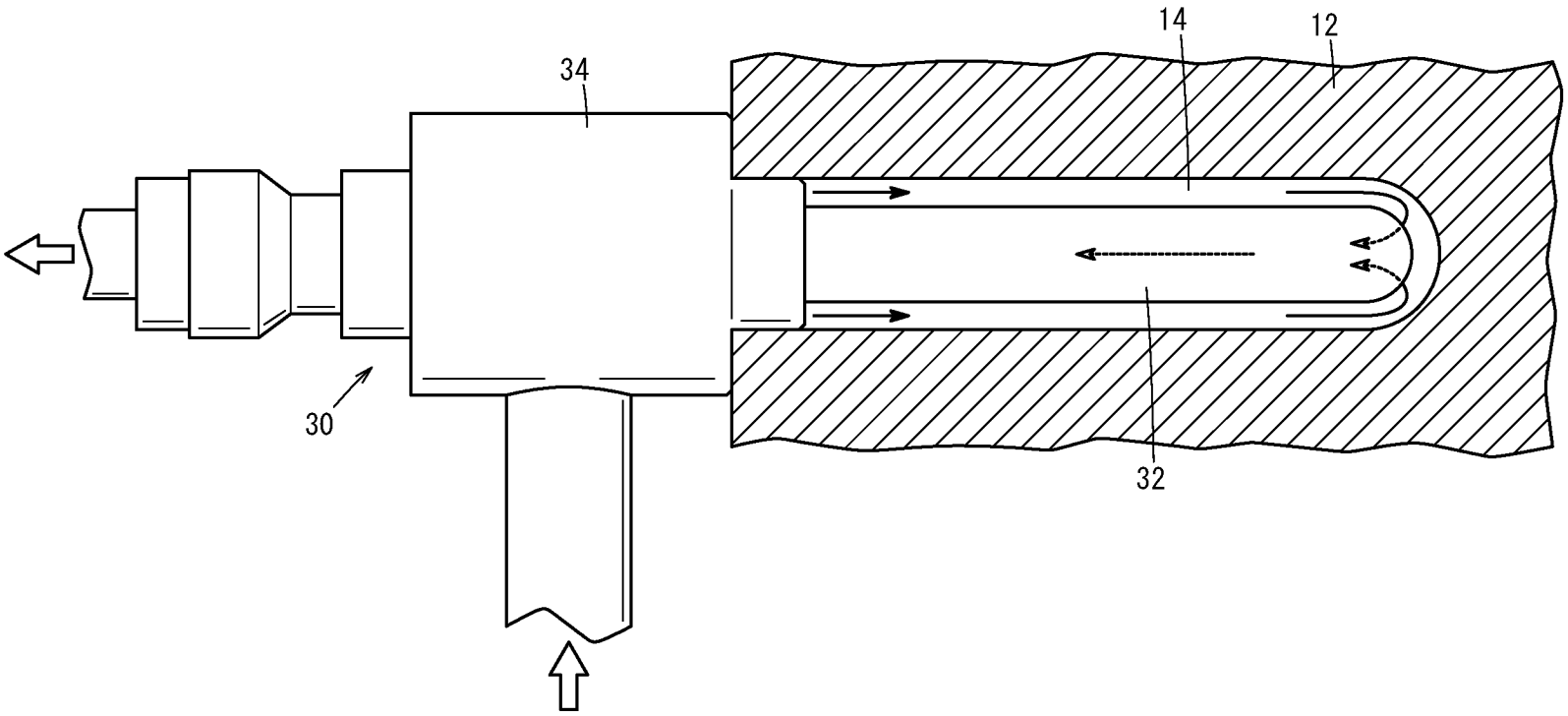
FIG. 2 is a schematic explanatory view for illustrating a plating method according to the embodiment of the present invention.

As shown in FIG. 2, an electroplating treatment using an electrolytic treatment apparatus 30 may be used in the plating method. The electrolytic treatment apparatus 30 has an electrode 32 and a supply/discharge portion 34, and further has a treatment liquid feeding means, a treatment liquid tank, and an external power source (not shown).

For example, the electrode 32 is a tubular body containing a platinum-coated titanium material or the like. The supply/discharge portion 34 is detachably attached to the opening of the coolant passage 14, and is used for supplying/discharging the plating solution to/from the electrode 32 and the coolant passage 14.

The treatment liquid feeding means is used for supplying the plating solution through the supply/discharge portion 34 into the coolant passage 14. The treatment liquid tank is used for storing the plating solution discharged from the coolant passage 14 through the supply/discharge portion 34. The external power source is used for supplying an electric current to the electrode 32, thereby generating an electric potential difference between the electrode 32 and the inner surface of the coolant passage 14.

Thus, in the electrolytic treatment apparatus 30, an end of the electrode 32 protruding from the supply/discharge portion 34 is inserted into the coolant passage 14, and then the plating bath is provided from the treatment liquid feeding means to the supply/discharge portion 34. The plating solution flows between the outer periphery of the electrode 32 and the inner surface of the coolant passage 14, and reaches the end of the electrode 32 (the bottom of the coolant passage 14). The plating solution further flows from an opening formed on the end of the electrode 32 through the inside of the electrode 32 to the supply/discharge portion 34, and is collected in the treatment liquid tank. The collected plating solution is supplied again from the treatment liquid feeding means to the supply/discharge portion 34. That is, the plating bath is circulated in the electrolytic treatment apparatus 30 and the coolant passage 14.

In the electrolytic treatment apparatus 30, a liquid such as a degreasing washing liquid, an etching liquid, a desmutting liquid, or water may be supplied to the supply/discharge portion 34 instead of the plating bath. The liquid may be circulated in the coolant passage 14. Thus, the treatment liquid feeding means may be used for supplying the liquid instead of the plating bath to the supply/discharge portion 34. The treatment liquid tank may be used for storing the liquid discharged from the supply/discharge portion 34.

In the plating method using the electrolytic treatment apparatus 30, first, the electrode 32 is inserted into the coolant passage 14, and the supply/discharge portion 34 is attached to the opening of the coolant passage 14. Then, the degreasing washing liquid (such as a water-soluble alkaline detergent) is supplied from the supply/discharge portion 34 to the coolant passage 14, to carry out a degreasing step for removing an oil component from the inner surface of the coolant passage 14 (the surface to be plated).

Next, the etching liquid (such as a 10-Wt % aqueous hydrochloric acid solution or a 10-Wt % aqueous sulfuric acid solution) is supplied through the supply/discharge portion 34 to the coolant passage 14, to carry out an etching treatment step for removing an oxide layer from the inner surface of the coolant passage 14. In the etching treatment step, an electrolytic etching treatment (an anodic electrolysis treatment) may be performed while applying an electric current from the external power source to the electrode 32.

Next, the desmutting liquid (such as a solution of a mixture of sodium hydroxide and sodium citrate) is supplied through the supply/discharge portion 34 to the coolant passage 14, to carry out a desmutting step. In the above etching treatment step, the oxide layer is removed, whereby a water-insoluble metal component (a smut component) is exposed on the inner surface of the coolant passage 14. In the desmutting step, the smut component is removed from the coolant passage 14.

Also in the desmutting step, an electrolytic treatment (a cathodic or anodic electrolysis treatment) may be performed while applying an electric current from the external power source to the electrode 32. In this case, the desmutting liquid is electrolyzed in the coolant passage 14 to generate oxygen, whereby the smut component can be removed more effectively.

Next, the plating bath is supplied through the supply/discharge portion 34 to the coolant passage 14, and an electric current is applied from the external power source to the electrode 32, to carry out an electroplating treatment in a plating step. In the plating step, for example, the plating solution having a temperature of 35° C. is supplied to the coolant passage 14 at a flow rate of 1 m/second. For example, the electric current applied to the electrode 32 is controlled in such a manner that the current density is 10 $A/dm^2$ on the inner surface of the coolant passage 14. The plating coating 10 can be formed on the inner surface of the coolant passage 14 in this manner.

The obtained plating coating 10 can have both of a hydrophilic property and an anticorrosion property. A sediment derived from calcium, bacterium, or the like in the coolant water can be easily washed out with water due to the hydrophilic property, and generation of a corrosion product can be prevented due to the anticorrosion property.

Thus, when the pH value is controlled within the above range by using the ammonium-based dispersant, 7 Vol % or more of the hydrophilic silicon dioxide particles 22 can be effectively co-deposited while preventing the recrystallization or the like of the zinc source or the nickel source. In this case, for example, the plating coating 10 can have a water contact angle of less than 40°, resulting in the excellent hydrophilic property. Furthermore, when the silicon dioxide particles 22 have a scale-like shape or a dendritic shape, the silicon dioxide particles 22 can have a specific surface area larger than that of grain-shaped particles, whereby the plating coating 10 can have an improved hydrophilic property.

Thus, even when the sediment is attached to the plating coating 10, water can easily penetrate between the sediment and the plating coating 10, so that the sediment can be easily removed from the inner surface of the coolant passage 14. Consequently, the sediment can be easily removed from the coolant passage before the amount of the attached sediment is increased.

For example, a melt having a temperature of 500° C. or higher may be injected into the cavity formed in the mold 12. When the deposited nickel content is controlled within the above range, the plating coating 10 is excellent in heat resistance and is not decomposed even at such a high temperature. Furthermore, even when the silicon dioxide particles 22 are deposited as described above, the plating coating 10 can have a satisfactory thermal conductivity, so that thermal exchange between the coolant water and the inner surface of the coolant passage 14 is not inhibited by the plating coating 10.

The matrix 20 of the plating coating 10 contains a zinc-nickel alloy. The zinc-nickel alloy has an ionization tendency higher than that of the steel material such as SKD61 in the base material of the mold 12. In addition, the electric potential difference between the steel material and the zinc-nickel alloy is smaller than that between the steel material and another metal material having an ionization tendency higher than that of the steel material.

When the inner surface of the coolant passage 14 is covered with the plating coating 10 containing the matrix 20, the contact of water with the inner surface (the base material) can be prevented. Even if a part of the inner surface of the coolant passage 14 (the base material) is exposed on the plating coating 10, a sufficient sacrificial anticorrosion effect can be achieved. In addition, because the electric potential difference between the plating coating 10 and the inner surface of the coolant passage 14 (the base material) is small as described above, generation of a corrosion current can be prevented. Consequently, the inner surface of the coolant passage 14 can exhibit an effectively improved corrosion resistance.

Because the co-deposited nickel content is controlled within the above range and the nickel can have the y single phase structure in the plating coating 10, the corrosion resistance of the plating coating 10 can be further improved. Consequently, the attachment of the corrosion product to the inner surface of the coolant passage 14 can be prevented by forming the plating coating 10.

The plating coating 10 has a thickness of 50 to 300 μm as described above. Therefore, even when the plating coating 10 is exposed to a water pressure of the coolant water running through the coolant passage 14, the plating coating 10 can be prevented from being broken or peeled off from the inner surface of the coolant passage 14. Furthermore, in a case where the degreasing step, the etching treatment step, and the desmutting step are carried out prior to the plating step, the plating coating 10 can be formed more effectively on the inner surface of the coolant passage 14. The durability of the plating coating 10 can be improved in this manner.

Even when the mold 12 is continuously used, the plating coating 10 formed on the inner surface of the coolant passage 14 can be maintained in a good state, so that the increase in the amount of the sediment attached and the attachment of the corrosion product can be effectively prevented. Therefore, the thermal exchange via the coolant passage 14 between the coolant water and the mold 12 can be prevented from being inhibited by the corrosion product having a low thermal conductivity. Furthermore, the coolant water can be efficiently circulated through the coolant passage 14. Consequently, the control of the temperature of the mold 12 can be stably performed, so that the mold 12 can be maintained at an optimum temperature in a molding process, and the mold 12 can be efficiently cooled after a molding process. Furthermore, the maintenance cycle of the mold 12 can be prolonged.

The present invention is not particularly limited to the above embodiment, and various changes and modifications may be made therein without departing from the scope of the invention.

For example, although the plating coating 10 is formed on the inner surface of the bottomed hole (the coolant passage 14) in the mold 12 in the above embodiment, the subject to be covered with the plating coating 10 is not particularly limited to the bottomed hole. The plating coating 10 may be formed on an inner surface of a line-shaped coolant passage instead of the bottomed hole. A subject other than the coolant passage of the mold may be covered with the plating coating 10.

DESCRIPTION OF REFERENCE NUMERALS AND SIGNS

10 . . . Plating coating
12 . . . Mold
14 . . . Coolant passage
20 . . . Matrix
22 . . . Silicon dioxide particle
30 . . . Electrolytic treatment apparatus
32 . . . Electrode
34 . . . Supply/discharge portion

The invention claimed is:

1. A zinc-nickel composite plating bath comprising a zinc source, a nickel source, a silicon dioxide particle, and an ammonium-based dispersant for forming a zinc-nickel composite plating coating having a co-deposited nickel content of 10 to 16 Wt % and a co-deposited silicon dioxide particle content of 7 Vol % or more, wherein the zinc-nickel composite plating bath has a pH of 5.6 to 6.8, wherein the silicon dioxide particle has a scale-like shape or a dendritic shape.

2. The zinc-nickel composite plating bath of claim 1, wherein the zinc-nickel composite plating bath has a pH of 6.1 to 6.8.

3. The zinc-nickel composite plating bath of claim 1, wherein the zin-nickel composite plating bath comprises 50 g/L of zinc chloride as the zinc source, 30 g/L of a nickel chloride as the nickel source, 200 g/L of the silicon dioxide particles and 200 g/L of the ammonium-based dispersant.

4. A plating method for forming a zinc-nickel composite plating coating on a surface of a steel material to be plated, the plating method comprising:

a degreasing step of removing an oil component from the surface to be plated;

an etching treatment step of removing an oxide layer from the surface to be plated after oil component removal;

a desmutting step of removing a water-insoluble metal component from the surface to be plated after oxide layer removal; and a plating step of subjecting the surface to be plated to an electroplating treatment using a zinc-nickel composite plating bath after metal component removal to form the zinc-nickel composite plating coating, wherein the zinc-nickel composite plating bath contains a zinc source, a nickel source, a silicon dioxide particle, and an ammonium-based dispersant, the zinc-nickel composite plating bath has a pH of 5.6 to 6.8, wherein the silicon dioxide particle has a scale-like shape or a dendritic shape, and the zinc-nickel composite plating coating has a co-deposited nickel content of 10 to 16 Wt % and a co-deposited silicon dioxide particle content of 7 Vol % or more.

5. The plating method according to claim 4, wherein the steel material is a mold, and the surface to be plated is an inner surface of a coolant passage formed in the mold.

6. The plating method of claim 4, wherein the zinc-nickel composite plating bath has a pH of 6.1 to 6.8.

7. The plating method of claim 4, wherein the zin-nickel composite plating bath comprises 50 g/L of zinc chloride as the zinc source, 30 g/L of a nickel chloride as the nickel source, 200 g/L of the silicon dioxide particles and 200 g/L of the ammonium-based dispersant.

* * * * *